US005791664A

United States Patent [19]

Koester, Jr.

[11] Patent Number: 5,791,664

[45] Date of Patent: Aug. 11, 1998

[54] BRAKING SYSTEM FOR IN-LINE SKATES

[76] Inventor: Frank A. Koester, Jr., 15233 SE. 176th Pl., Renton, Wash. 98058

[21] Appl. No.: 781,233

[22] Filed: Jan. 10, 1997

[51] Int. Cl.[6] ..... A63C 17/06; A63C 17/14

[52] U.S. Cl. ..... 280/11.2; 280/11.22

[58] Field of Search ..... 280/11.2, 11.22, 280/87.041, 87.042, 11.27, 11.28

[56] References Cited

U.S. PATENT DOCUMENTS

| | | | |
|---|---|---|---|
| 5,183,275 | 2/1993 | Hoskin | 280/11.2 |
| 5,211,409 | 5/1993 | Mitchell et al. | 280/11.2 |
| 5,253,882 | 10/1993 | Mitchell | 280/11.2 |
| 5,316,325 | 5/1994 | Mitchell et al. | 280/11.2 |
| 5,330,207 | 7/1994 | Mitchell | 280/11.2 |
| 5,439,238 | 8/1995 | Neal | 280/11.2 |
| 5,464,235 | 11/1995 | Goldman et al. | 280/11.2 |
| 5,465,984 | 11/1995 | Pellegrini, Jr. et al. | 280/11.2 |
| 5,505,469 | 4/1996 | Zorzi et al. | 280/11.2 |
| 5,511,804 | 4/1996 | Pellegrini et al. | 280/11.2 |
| 5,564,718 | 10/1996 | Mitchell et al. | 280/11.2 |
| 5,584,491 | 12/1996 | Kronyak, Jr. | 280/11.2 |
| 5,630,595 | 5/1997 | Perner | 280/11.2 |
| 5,630,597 | 5/1997 | Klukos | 280/11.2 |
| 5,655,783 | 8/1997 | Brosnan | 280/11.2 |
| 5,664,794 | 9/1997 | Mitchell et al. | 280/11.2 |
| 5,704,619 | 1/1998 | Mitchell et al. | 280/11.2 |

*Primary Examiner*—Richard M. Camby
*Assistant Examiner*—Bridget Avery
*Attorney, Agent, or Firm*—Terrance L. Siemens

[57] ABSTRACT

A cable operated, in-line skate braking system that is originally or retrofittedly attached to an in-line skate. The braking system has rigid main body portions laterally disposed of the shoe component of the skate and can be part of the right skate, the left skate, or both. An actuating line is anchored at the user's waist, and is connected to the brake mechanism. Rearward of the shoe component, the rigid main body portion projects upwardly and away from the plane of the skating surface, and forms a pair of arms that holds the brake mechanism. The brake is slidably secured to the main body, and moves into contact with the ground when the actuating line is drawn. The skating surface engaging area of the brake body is held such that it is maintained parallel to the ground. The actuating line branches into two actuating cables that pass through guides and pulleys mounted on each of the skate. The actuating cables pass through a loop terminating the actuating line, so as to equalize force acting on each side of the brake.

7 Claims, 4 Drawing Sheets

BRAKING SYSTEM FOR IN-LINE SKATES

BACKGROUND OF THE INVENTION

1. Field of the Invention

The present invention relates generally to braking devices. More specifically, it relates to a braking device for a wheeled conveyance. Even more specifically, it relates to a braking mechanism for an in-line skate. Yet even more specifically, it relates to braking mechanism for an in-line skate that involves a T-shaped hand actuator grip, an actuator line that leads and splits, feeding pulleys mounted laterally on a frame over the skate and that brings a biased brake pad into contact with the skating surface, the brake pad being rectilinearly translated through its movement path. More generally, the device could be used in any application where even, controllable braking force on a wheeled conveyance is desired and where the user's activation would be at a distance from the wheel carriage.

Thus it can be seen that the potential fields of use for this invention are myriad and the particular preferred embodiment described herein is in no way meant to limit the use of the invention to the particular field chosen for exposition of the details of the invention.

A comprehensive listing of all the possible fields to which this invention may be applied is limited only by the imagination and is therefore not provided herein. Some of the more obvious applications are mentioned herein in the interest of providing a full and complete disclosure of the unique properties of this previously unknown general purpose article of manufacture. It is to be understood from the outset that the scope of this invention is not limited to these fields or to the specific examples of potential uses presented hereinafter.

2. Description of the Prior Art

In-line skates are a growingly popular sporting device in the present day. One of the most obvious problems in the sport is that braking on a hill or in the face of a hazard is difficult for beginners and, in the second case, can prove to be a problem even for the most experienced. This shortcoming has been inherent since the first "roller skates" were introduced, and has been addressed in various ways since that day.

The present invention attempts to provide an improved braking system for in-line skates that allows the user to precisely apply the amount of braking desired through a handheld grip attached to the belt of the user. The braking pad is translated rectilinearly through an actuator line and pulley system to bring it into contact with the skating surface, thus preventing the uneven wear that can result from the pivoted configuration that is prevalent in the prior art. Another advantage of the novel configuration of the present invention is that this rectilinear translation allows for the whole brake pad to meet the skating surface at once. Another feature of the present invention is that the travel guide means of the brake pad and its associated carrier are contained within a brake pad guide block, and this guide block is preferably surrounded by a flexible rubber dirt shield to prevent debris from jamming or otherwise hampering the movement of the brake pad when it is activated. A search in the United States Patent and Trademark Office uncovered a number of patents that relate to in-line skating brakes and these are discussed hereinbelow:

First is U.S. Pat. No. 5,253,882 issued on Oct. 19, 1993 to David N. Mitchell. This discloses a hand activated skate brake and method wherein a brake pad pivots at the rear of the skate to come into contact with the skating surface. This is unlike the present invention in that no rectilinear translation of the brake pad surface through fixed sliding guides is taught or disclosed.

In U.S. Pat. No. 5,330,207 issued on Jul. 19, 1994, also to David N. Mitchell there is disclosed a similar hand activated skate brake and method. This, as above, does not discloses the rectilinear motion of the present invention's brake pad being carried on along fixed, mounted guide rails.

Another patent of interest is U.S. Pat. No. 5,439,238 issued on Aug. 8, 1995 to Stuart Neal. This is a braking system for in-line skates wherein the brake pad, mounted on a U-shaped bracket (similar to the bracket in the Mitchell patents above), pivots to engage the rearmost wheel of the skate. This is clearly unlike the present invention in that there is no rectilinear translation of the brakepad into contact with the skating surface.

Next is U.S. Pat. No. 5,464,235 issued on Nov. 7, 1995 to David A. Goldman, et al. This is a brake lock for an in-line roller skate. Unlike the present invention, this device describes a brake pad that engages a wheel of the skate and is mainly directed at a locking and unlocking mechanism in the gripper handle of the apparatus that allows the user to walk without rotation of the wheels when desired.

Lastly, in U.S. Pat. No. 5,505,469 issued on Apr. 9, 1996 to Claudio Zorzi, et al. there is disclosed braking device for skates wherein an articulated shoe portion of the skate is rotatable to engage the brake portion of the device. This is clearly dissimilar from the present invention in that there is no showing of the brake pad being moved in rectilinear fashion to engage the skating surface; nor is there any teaching of the retrofittable brake attachment, the cable guides or pulleys, or the hand activation means of the present invention.

None of the above inventions and patents, taken either singly or in combination, is seen to describe the improved in-line braking system invention as claimed.

SUMMARY OF THE INVENTION

Briefly, the invention comprises a braking system for roller skates. The braking system is originally or retrofittedly attached to either side of the axles of in-line skates. The braking system is cable operated by a handle attached to the user's waist. The cable acts on a movable brake friction component, or brake body, secured to the shoe component of the skate by a rigid main body portion of the brake. The brake may be part of the right skate, the left skate, or both.

Rearwardly of the shoe component of the skate, the rigid main body portion projects upwardly from the plane of the skating surface, and forms a pair of arms that hold the brake slide receiver, the biased brake slide, and the brake body itself. The skating surface engaging area of the brake body is held such that the brake body is disposed above, and is generally parallel to, the skating surface.

The line branches into two actuator cables which pass through guides and pulleys mounted on each of the laterally disposed rigid main body portions of the apparatus. These actuator lines attach to the brake, and are prevented from binding by a suitable guide. The brake is disposed to slide along a holding member at an angle to the ground. The braking surface is parallel to the ground at all times, thereby assuring maximal contact therewith when braking. This relationship will be referred to as sliding the brake in a rectilinear fashion into contact with the skating surface.

Accordingly, it is a principal object of the invention to provide a new and improved braking system for in-line skates which overcomes the disadvantages of the prior art in a simple but effective manner.

It is a major object of this invention to provide a braking system for in-line skates where the user can easily activate the brake by manipulating a conveniently disposed handle means.

It is another object of the invention to provide a braking system for in-line skates wherein the brake pad translation is accomplished by a simple actuator line and pulley system.

It is another object of the invention to provide a braking system for in-line skates where the brake pad is translated in a rectilinear manner to bring the complete skating surface engagement portion of the brake pad into engagement with the skating surface, thus eliminating uneven wear.

A further object of the invention is to avoid binding of a cable operating the brake.

Yet another object of the invention is to provide a braking system for in-line skates wherein the brake pad is carried along a guide sleeve held at an angle relative to the skating surface, and where the brake pad is correspondingly angled to simultaneously bring the largest braking engagement surface area into contact with the skating surface.

Still yet another object of the invention is to provide a braking system for in-line skates that minimizes the possibility of clogging or otherwise jamming the brake mechanism through the inadvertent introduction of dirt or debris by providing an internally mounted guide sleeve for the biased brake pad carrier within a guide block, and then further covering the guide block with a resilient flexible sleeve.

It is a general goal of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

The present invention meets or exceeds all the above objects and goals. Upon further study of the specification and appended claims, further objects and advantages of this invention will become apparent to those skilled in the art.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

Figure 1:
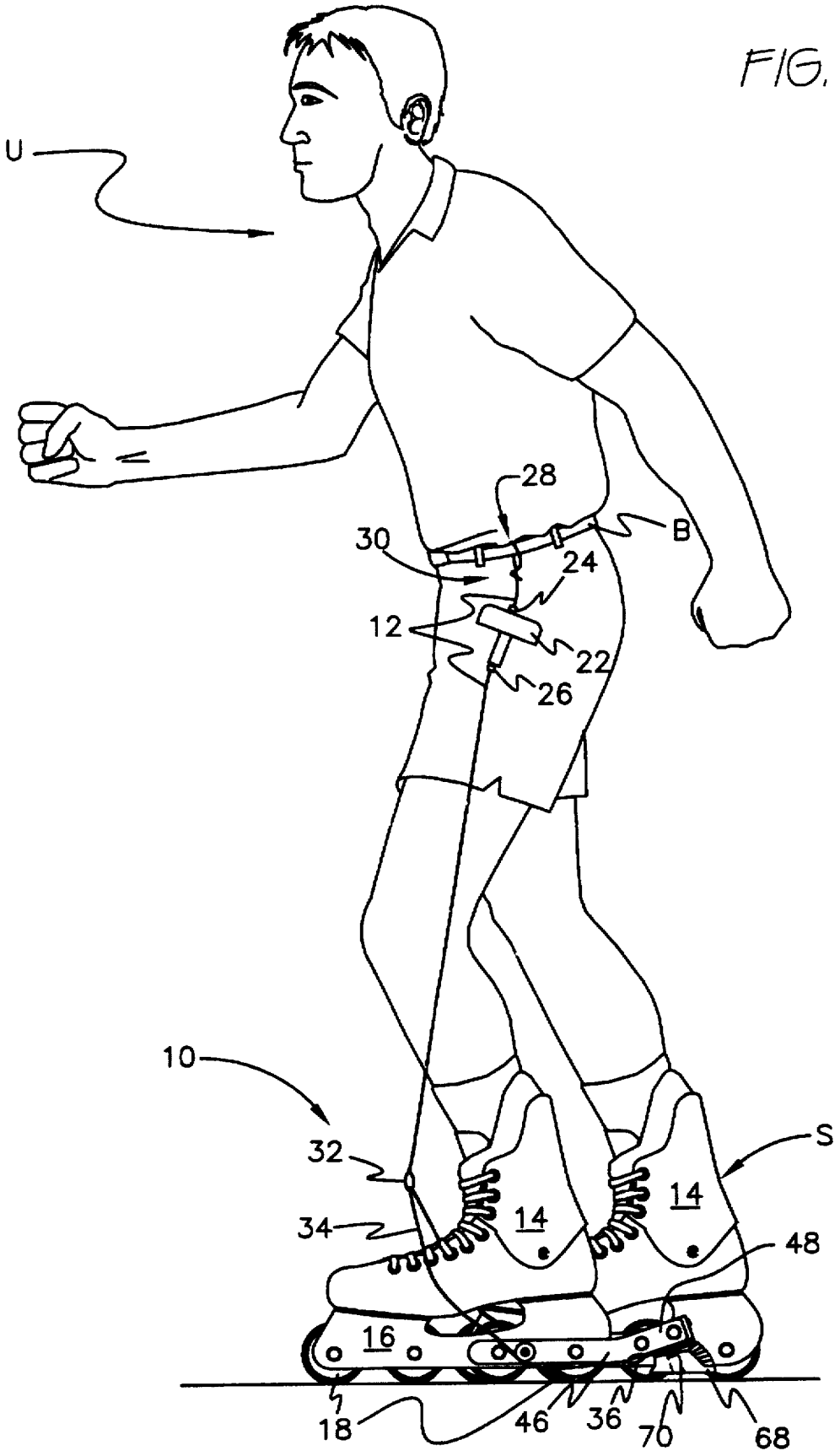
FIG. 1 is an environmental view of the present brake device with a user showing the preferred placement of the handle actuation means.

The preferred embodiment of the present invention is generally designated at 10 in FIG. 1. In this Figure, the arrangement of the main actuator line 12 is seen. The main overall features will be discussed first, and then reference to the other Figures in this description will be made to fully enable the skilled practitioner to practice the present invention. The user U is shown at rest. The typical in-line skate, such skates being sold under various brand names, such as ROLLERBLADE, BAUER, CLAIFORNIA PRO, and the like is shown generally indicated at S. The skates of these types usually have two main components: the shoe, indicated at 14 and the wheel carriage, indicated at 16. It should be understood at the outset that various types of these skates are available, and that the present invention could be easily adapted to fit a wide variety of these devices. Attached to the wheel carriage 16 are the skate wheels 18. In the types of skates commonly sold today, these wheels number four. Other numbers of wheels could be employed without at all affecting the practice of the invention.

In the embodiment described herein, the user U is wearing a belt B. Running from the belt B downwards towards the skate S is main actuator line 12. Attached to the main actuator line 12 is a T-shaped handle or actuator grip 22. The handle could, of course, be many other shapes, with the T-shape used here being well known and commonly available. It is contemplated that the main actuator line 12 be made of one eighth inch nylon line, though other materials such as nylon combined with an elastic material, could be used. The T-shaped handle 22, in this embodiment, is attached to actuator line 12 at two points located part way along the main actuator line 12, as indicated at 24 and 26. The first end 28 of the main actuator line 12 is looped around the belt B and secured, as indicated at 30. The second end 32 of the main actuator line 12 terminates proximate the shoe portion 14, slightly forward of the ankle. In the embodiment shown here, the main actuator line 12 terminates in a loop that receives through it the brake pad actuator cable 34. This pad actuator cable 34 passes through the terminal end 32 of the main line 12 at its approximate midpoint and the two ends of the pad actuator cable 34 themselves end in loops 36, 38, laterally disposed along the rear area of the wheel carriage 16. This configuration will be discussed in further detail below.

Figure 2:
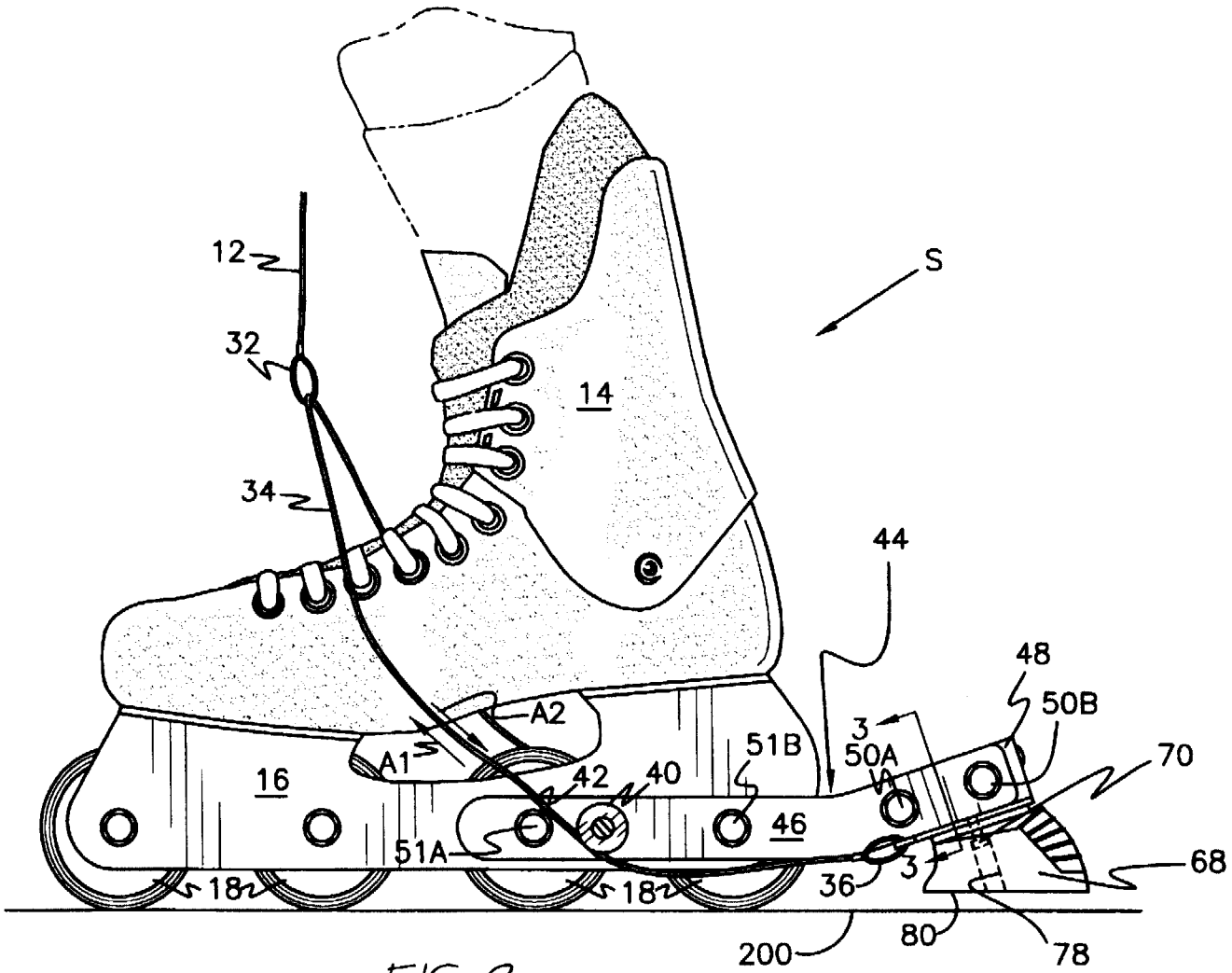
FIG. 2 is an enlarged side view of a single skate with the improved in-line braking system attached thereto.

Turning now to FIG. 2, an enlarged side view of the skate S is seen. One half of the pad actuator cable 34 extends downwardly from the terminus of main actuator line 12 and passes between a pulley 40 and a line guide 42 attached to one of the main rigid side body portions 44 of the apparatus. The terminus of line 12 is a loop 32 which enables cable 34 to self-center. This signifies that cable 34 slides laterally at loop 32 to maintain equal tension on both halves of cable 34. It should be clarified at this point that the opposite side if the skate S is configured in the same manner: that is, the opposite side is a mirror image of what is seen in FIG. 2. Therefore, there exists a section of line 34 concealed from view in FIG. 2 that is a mirror image of the visible portion of line 34. These two sections or halves of cable 34 are maintained at equal tension by slidable engagement of loop 32, thereby transferring equal force to the brake.

Regarding the rigid main body side portion 44 of the device, it can be seen that it is made up of a wheel attachment portion 46 and a rearwardly disposed angled portion 48 supporting the brake. The wheel attachment portion 46 is connected to the two most rearward axles of the skate S, indicated at 51A and 51B. This attachment is preferably accomplished by well known means such as bolts that would not interfere with rotation of the wheels when the skate S is in use.

As it can be seen from FIG. 2, the line guide 42 comprises an upwardly exposed ramp located just forwardly of the pulley 40 and positioned such that the pad actuator cable 34 passes between these components, constrained against potential lateral displacement which could cause disengagement of cable 34 from pulley 40, but free to move as indicated by directional arrows Al and A2. It will be seen that the lower end of the ramp of guide 42 is closer to pulley 40 than is the upper end thereof. Therefore, guide 42 serves not only as a member preventing disengagement of cable 34 from pulley 40 by simple interference, but also progressively constrains cable 34 into a position proximate pulley 40 as cable 34 approaches pulley 40. This characteristic reduces tendency of cable 34 to bind and jam, as might otherwise occur.

Again, it should be emphasized that this construction is substantially identical on both sides of the skate S, as can be seen in the bottom plan view of FIG. 4, discussed in more detail below.

The discussion now turns to the rear angled portion 48 of the rigid main body side portion 44. The two rear angled portions 48 together on both sides of the skate S serve as a mounting for the braking mechanism. A friction component of the braking mechanism is slidably mounted within a brake supporting member such that it can move between a braking position wherein the friction component, or brake, contacts the ground to generate drag or braking force, and an idle position wherein the brake is out of contact with the ground.

The brake supporting member includes a guide receiving block 50. Block 50 is attached to both rear angled portions 48 of the rigid main body side portion 44 by threaded fasteners as indicated at 50A and 50B in FIG. 2. It would be obvious to a skilled practitioner that a wide multitude of other attachment means could be utilized to the same ends, such as forming block 50 integrally with one or both main body portions 44.

Figures 3, 5:
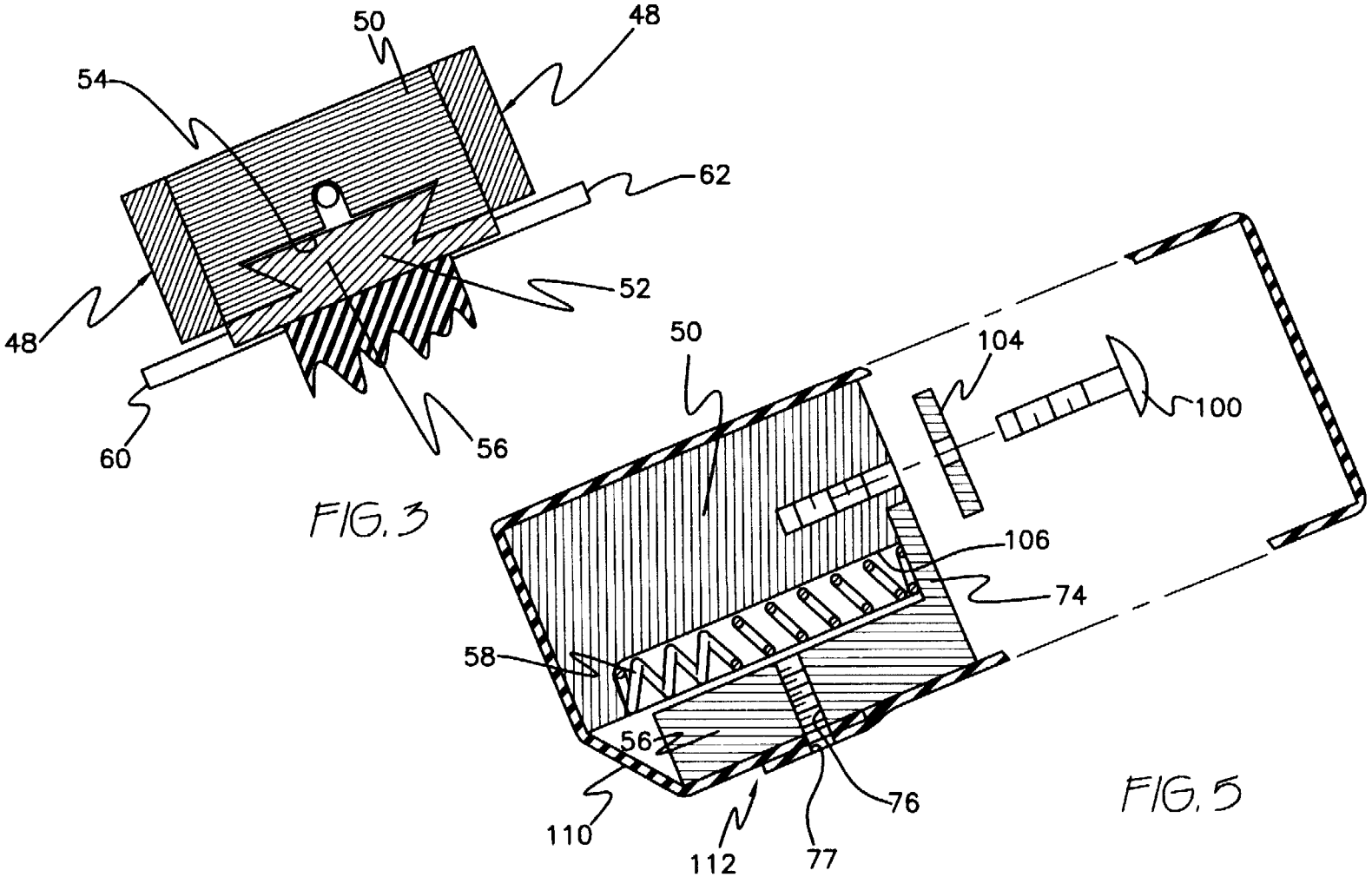
FIG. 3 is a sectional view taken along line 3—3 of FIG. 2 showing the internal arrangements of the guide sleeve block and the brake pad carrier.
FIG. 5 is a partially exploded sectional view taken along line 5—5 of FIG. 4 showing further details of the biasing means for the brake pad carrier and showing the preferred disposition of the rubber dirt shield.

Turning to FIG. 3, the internal details of the preferred form of the guide receiving block 50 and the brake pad guide 52 are seen. Brake pad guide 52 is a structural member to which the brake pad 68 is attached, and which also supports structure enabling slidable engagement with block 50.

Slidable engagement is enabled by dovetailed cooperation between brake pad guide 52 and block 50. A dovetailed receiving channel 54 formed in block 50 cooperates with a dovetailed guide extension 56 of guide 52. The fit between these cooperating structures is such that mutual movement of brake pad guide 52 is prevented except in the direction imparted by the pad actuator cable 34 and the opposing direction when guide 52 is returned under the influence of the biasing spring 58, seen in FIG. 5.

Below the dovetailed guide extension 56, and extending outwardly from brake pad guide 52 to right and left sides are pad actuator receiving ears 60, 62 (see FIG. 4). Each of the ears 60, 62 contains an aperture 64 or 66 to allow them to receive the distal terminal ends 36, 38 of the pad actuator cable 34, as best seen in FIG. 4. As mentioned above, in the embodiment described herein, these terminal ends are loops. However, it should be understood that other types of attachment means could be utilized.

Figure 4:
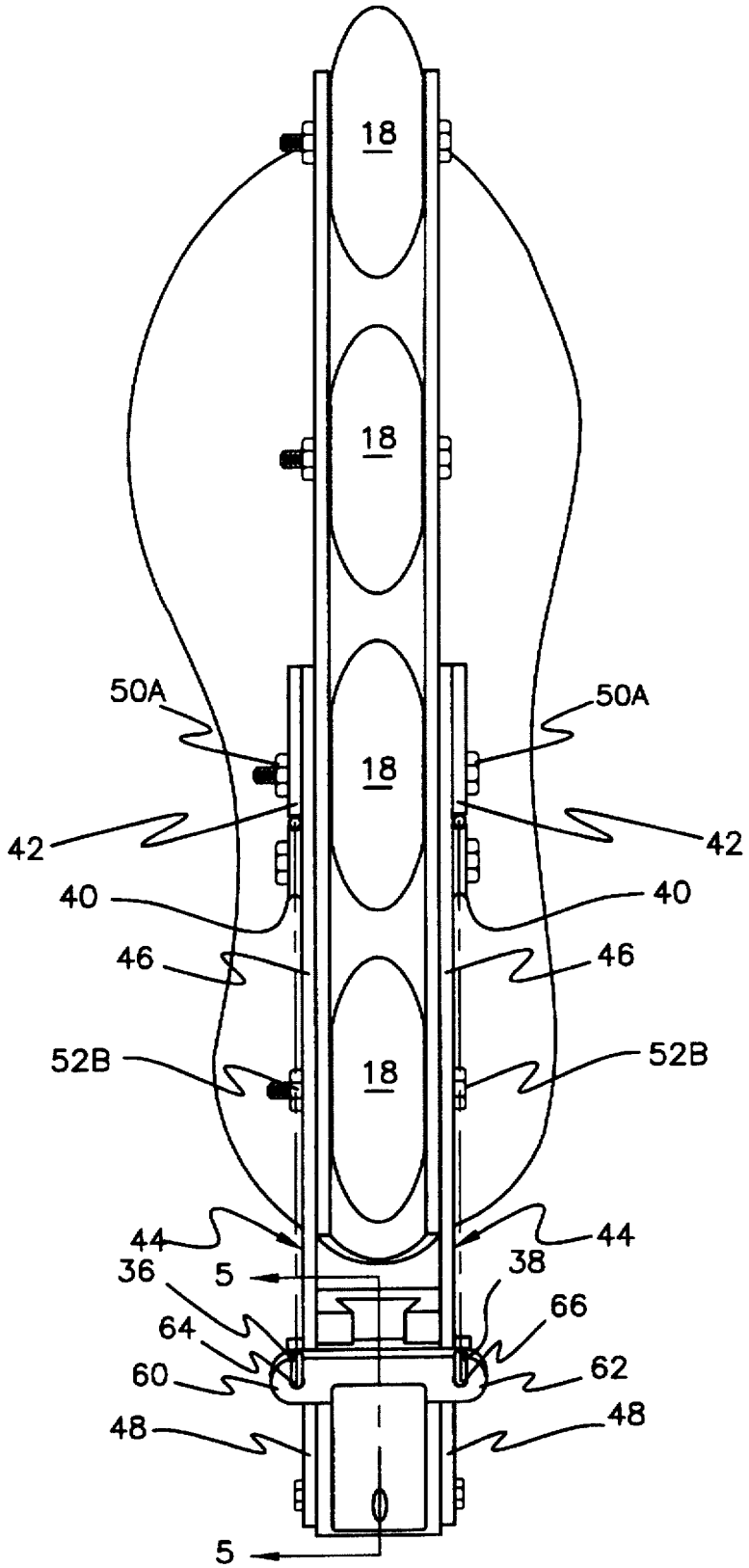
FIG. 4 is a bottom plan view of the improved braking system showing further details of its attachment to the in-line skate, the location of the pulleys, and the actuator cable connections to the brake pad carrier.

Best seen in FIGS. 1 and 2, the friction component, or brake pad 68, is attached to the guide extension 56 (see FIG. 3) to receiving ears 60, 62 (see FIG. 4). In FIG. 2 it can be seen that in the preferred embodiment, the brake pad 68 is attached to the guide extension 56 by threaded connector 70. This brake pad 68 is of the type currently found mounted on existing in-line skates, made of a material having a sufficiently high friction coefficient to assist in bringing the user U to a halt when the apparatus 10 is activated. The extension 56, receiving ears 60, 62, and brake pad 68 are integral, or alternatively are rigidly connected by means well known in the art and obvious to a skilled practitioner.

Referring to FIG. 5, the brake pad return mechanism is seen. This, in the preferred embodiment, comprises a bias means located within the guide receiving block 50, this being a spring indicated at 58 that lies above the upper, flat portion 71 of the dovetailed guide extension 56. The spring 58 is contained within a semi-cylindrical recess 72 that lies above the dovetailed receiving channel 54. Semi-cylindrical recess 72 cooperates with the brake guide return plate 74 that is integral with, and extends from, the dovetailed guide extension 56, to define the chamber enclosing spring 58.

A stop 100 prevents brake pad guide 52 from escaping from guide block 50. In the preferred embodiment, this stop 100 is a threaded bolt 102 having a washer 104 that extends over the open end 106 of the semi-cylindrical recess 72 so as to interfere with return plate 74, thereby entrapping brake pad guide 52. Thus, when the user U ceases to urge the brake pad 68 into contact with the skating surface 200 (see FIG. 2), the brake pad guide 52 is urged back into the "at rest" position by spring 58, simultaneously pulling brake pad 68 out of contact with the surface 200.

FIG. 5 shows block 50 and brake pad guide 52 at an angle to the horizontal. This angle, also discernible in FIG. 2, provides the function of maintaining the friction surface 80 parallel to the ground surface 200. This orientation of surface 80 is maintained at all times, thereby maximizing frictional contact between brake 68 and ground surface 200.

As mentioned above, the present invention can be used on the right or left skate, or could be employed on both. In use, when user U wishes to slow or stop, T-shaped handle 22 is gripped and moved in the such that main actuator line 12 engages the pad actuator cable 34 in the direction indicated by directional arrow Al. Thus, brake pad 68 is brought into contact with the skating surface 200. In the event of the system failing, the user U could, alternately, simply tilt the skate rearward to bring pad 68 into contact with the skating surface 200.

Another feature of the present invention is the protective cover 110, seen in FIG. 5. This is a flexible rubber covering that surrounds the guide block 50, and the brake pad guide 52. The cover 110 overlaps, as indicated at 112, and the brake pad 68 is attached on the outside thereof. Fastener 70 securing brake pad 68 to brake pad guide 52 threads into hole 76, passing through holes 77 formed in cover 110 and hole 78 formed in brake pad 68. Cover 110 prevents debris or other contaminants from entering the receiving channel 54 and jamming or otherwise interfering with the free travel of the brake pad guide 52.

It is to be understood that the provided illustrative examples are by no means exhaustive of the many possible uses for my invention.

From the foregoing description, one skilled in the art can easily ascertain the essential characteristics of this invention and, without departing from the spirit and scope thereof, can make various changes and modifications of the invention to adapt it to various usages and conditions.

It is to be understood that the present invention is not limited to the sole embodiment described above, but encompasses any and all embodiments within the scope of the following claims:

I claim:

1. A brake system for a wheeled skate ridden on a skating surface, comprising:

hand grip actuation means, including an actuating line;

a rigid frame portion including wheel axle attachment means;

a brake pad guide having a downwardly projecting brake pad and means for engaging said actuating line;

a brake supporting member connected to said rigid frame portion and having engagement means for enabling slidable engagement of said brake pad guide with said brake supporting member positioned at an angle with more of a horizontal than vertical component to the skating surface on which the wheeled skates ride, said actuating line disposed to slide said brake pad guide along said brake supporting member responsive to tension being applied to said actuating line, thereby drawing said brake pad into contact with the skating surface.

2. The brake assembly according to claim 1, said brake pad guide and said brake supporting member being dimensioned and configured to interfit in dovetailed manner.

3. The brake assembly according to claim 1, where said hand grip actuation means includes a T-shaped handle.

4. The brake assembly according to claim 1, wherein said rigid frame portion comprises a pair of side plates, each said side plate attached on one side of the skate and bolted to two rearmost axles of the skate, and said brake supporting member is located posteriorly of the skate.

5. The brake assembly according to claim 4, further comprising two pulleys and two guides, one said pulley and an associated said guide disposed upon each one of said side plates, each said guide comprising an upwardly exposed ramp located just forwardly of the associated said pulley and positioned such that said actuating cable passes between said guide and the associated said pulley, each said ramp having a lower end disposed relatively close to the associated said pulley and an upper end disposed relatively further from the associated said pulley, said guides thereby preventing disengagement of said actuating cable from the associated said pulley by interference, and also progressively constraining said actuating cable into a position proximate each said pulley as said actuating cable approaches said pulley, thereby reducing tendency of said actuating cable to bind.

6. The brake assembly according to claim 1, said actuating line comprising a main actuating line having a terminus comprising a loop, and a pad actuator cable passing through said loop and having two pad actuator cable sections extending downwardly, each said pad actuator cable section engaging said brake pad guide, whereby said pad actuator cable is self-centering.

7. A brake system for a wheeled skate ridden on a skating surface, comprising:

actuator grip means, including an actuating line and a T-shaped handle;

a rigid frame portion comprising a pair of side plates including wheel axle attachment means, each said side plate attached on one side of the skate and bolted to the two rearmost axles of the skate;

a brake pad guide having a downwardly projecting brake pad and means for engaging said actuating cable;

a brake supporting member connected to said rigid frame portion posteriorly of the skate and having engagement means for enabling slidable engagement of said brake pad guide with said brake supporting member at an angle to the skating surface on which the wheeled skates ride, said brake pad guide and said brake supporting member being dimensioned and configured to interfit in dovetailed manner, said actuating cable disposed to slide said brake pad guide along said brake supporting member responsive to tension being applied to said actuating line, thereby drawing said brake pad into contact with the skating surface; and a removable flexible covering to prevent contamination of a slide receiving channel, said flexible cover partially surrounding said brake pad guide and said brake supporting member, said brake pad extending outside of said flexible cover, said rigid frame portion further comprising two pulleys and two guides, one said pulley and an associated said guide disposed upon each one of said side plates, each said guide comprising an upwardly exposed ramp located just forwardly of the associated said pulley and positioned such that said actuating cable passes between said guide and the associated said pulley, each said ramp having a lower end disposed relatively close to the associated said pulley and an upper end disposed relatively further from the associated said pulley, said guides thereby preventing disengagement of said actuating cable from said pulley by interference, and also progressively constraining said actuating cable into a position proximate each said pulley as said actuating cable approaches said pulley, thereby reducing tendency of said actuating cable to bind and jam.

* * * * *